US006286272B1

(12) United States Patent
Sandoz

(10) Patent No.: US 6,286,272 B1
(45) **Date of Patent: *Sep. 11, 2001**

(54) PROCESS FOR INSTALLING A COVERING CONSISTING OF PLANKS, LATHS OR THE LIKE

(76) Inventor: Jean-Luc Sandoz, Appartement 76 - Chemin de la Brume, 1110 Morges (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/446,714

(22) PCT Filed: Jul. 21, 1998

(86) PCT No.: PCT/FR98/01602

§ 371 Date: Dec. 22, 1999

§ 102(e) Date: Dec. 22, 1999

(87) PCT Pub. No.: WO99/06649

PCT Pub. Date: Feb. 11, 1999

(30) Foreign Application Priority Data

Jul. 29, 1997 (FR) ..... 97 09921

(51) Int. Cl.[7] ..... E04F 15/00

(52) U.S. Cl. ..... 52/177; 52/263; 52/385; 52/480; 404/46

(58) Field of Search ..... 52/177, 745.13, 52/745.2, 747.1, 391, 730.7, 480, 263, 385, 747.11; 404/34, 40, 41, 42, 43, 44, 46

(56) References Cited

U.S. PATENT DOCUMENTS

| | | | | |
|---|---|---|---|---|
| 168,672 | * | 10/1875 | Reed | 52/730.7 |
| 3,775,918 | * | 12/1973 | Johnson | 52/386 |
| 3,946,529 | * | 3/1976 | Chevaux | 52/177 X |
| 4,270,325 | * | 6/1981 | Mandelli | 52/391 |
| 5,299,402 | * | 4/1994 | Lee | 52/480 |
| 5,394,667 | * | 3/1995 | Nystrom | 52/480 |
| 5,513,472 | * | 5/1996 | Olsen et al. | 52/177 |
| 5,613,339 | * | 3/1997 | Pollock | 52/177 X |
| 5,642,592 | * | 7/1997 | Andres | 52/177 |
| 5,735,097 | * | 4/1998 | Cheyne | 52/177 X |
| 5,850,720 | * | 12/1998 | Willis | 52/480 |
| 6,012,254 | * | 1/2000 | Gaston | 52/745.13 X |
| 6,044,598 | * | 4/2000 | Elasser et al. | 52/177 X |

FOREIGN PATENT DOCUMENTS

| | | | | |
|---|---|---|---|---|
| 2123206 | | 11/1972 | (DE) . | |
| 2362166 | * | 6/1975 | (DE) | 52/287.1 |
| 2616077 | * | 10/1977 | (DE) | 52/391 |
| 3839019 | | 5/1990 | (DE) . | |
| 2201686 | * | 9/1988 | (GB) | 404/44 |
| 2229485 | | 9/1990 | (GB) . | |
| WO 94/01632 | * | 1/1994 | (WO) | 52/480 |

* cited by examiner

*Primary Examiner*—Laura A. Callo
(74) *Attorney, Agent, or Firm*—Wall Marjama & Bilinski

(57) ABSTRACT

Process for installing against a support (S), the ground in particular, a covering consisting of planks, laths, wooden panels (1) which consists in leveling the surface to be overlaid, then in fixing against the said surface (S), side-by-side planks (1), leaving a space between them and the ground. The process is characterized in that the spacing and the fixing of the planks (1) constituting the covering is obtained by means of pairs of elements (3, 4) distributed over the length of the said planks, which elements (3, 4) take the form of blocks, of which the one (3) is fixed transversely on the lower face of the plank and the second (4) over the ground, the opposite faces of the said blocks (3, 4) comprising interlockable complementary zones (7) ensuring the mutual securing of the said elements (3, 4).

9 Claims, 2 Drawing Sheets

PROCESS FOR INSTALLING A COVERING CONSISTING OF PLANKS, LATHS OR THE LIKE

TECHNICAL FIELD

The present invention deals with an improved process making it possible to install against a support, ground, wall, ceiling etc., a covering consisting of planks or laths made of wood, or other similar materials; it also deals with a new type of covering, flooring in particular, obtained by implementing this process.

In the subsequent description, the invention will be described in respect of the making of floors or terraces made outdoors and which are therefore subjected to inclement weather, but it is obvious that the invention is not limited to such an application and can be applied to any other sector where similar problems arise.

BACKGROUND OF THE INVENTION

A great many proposals have been made hitherto for making ground or wall coverings from wooden panels or planks.

Thus, the document DE 21 23 206 describes a covering consisting of wooden panels or planks which are fixed against a surface, side-by-side, leaving a space between the said surface and the underside of the covering.

According to this document, the spacing and the fixing of the elements of the covering is obtained by means of a pair of elements distributed, the one over the whole surface of the planks, the other against the surface to be overlaid.

Such fixing elements call upon clipable cones disposed against the entire surface to be overlaid and the underside of the covering.

Such a fixing means which is envisaged for use for making interior parquet floors cannot, in any circumstances, allow its use to be contemplated for making exterior wooden floors or terraces on account of the fact that the main problem which arises in such circumstances is that of the durability of the constructed works which are subjected directly to inclement weather and the sun.

Indeed, wood being a biopolymer, it is by definition biodegradable, especially as regards the cellulose and hemicellulose compounds, since these compounds are in fact polysaccharides (chemistry of sugars), and therefore offer very little resistance over time, and are much coveted by microorganisms of the xylophagous type.

Accordingly, if good outdoor durability of the wood is required, it is vital to comply with two essential conditions, namely not to have direct contact with the ground and not to allow water (rain or similar) to stagnate or remain trapped on or in the wood.

Moreover, it is obvious that the durability will also depend on the species of wood used and also on any treatment, for example chemical treatment in a high-pressure autoclave, which increases durability.

Lastly, in the case of terraces or other external works, it is vital to achieve a structure which makes it possible to support the passage of considerable loads, such as for example an urban cleaning machine.

The solution described in the aforesaid patent does not in any event make it possible to solve such problems.

Indeed, in this document, the fixing elements call upon clipable cones disposed against the entire surface to be overlaid and the underside of the covering.

If such a fixing means is envisaged for a covering intended to be used outdoors, during such use, all of the cone surfaces can fill with water, and this will cause degradation of the wooden structure.

Additionally, the solution of this document does not in any event allow ventilation of the lower layers of the covering.

Moreover, the use of cones distributed over the entire surface demands deployment on a perfectly flat surface and does not allow any adjustment.

Lastly, the solution described in this document can be regarded as a non-structural solution and would therefore not be able to support the passage of considerable loads, such as for example urban cleaning machines.

SUMMARY OF THE INVENTION

Now, a simple and efficient process has been found, and it is this which is the subject of the present invention, which makes it possible, in the case of terraces or floors implemented outdoors, not only to distance the laths, panels, planks of wood from the ground, thus allowing ventilation and run-off of water after rain, but also permits a possibility of fixing the structure from the underside, eliminating any risks of entry of water by capillarity which occurs when using means of fixing from above (screws, bolts).

Moreover, the process in accordance with the invention permits the production of structure coverings making it possible to support the passage of considerable loads, such as urban cleaning machines.

In a general manner, the invention therefore relates to a process for installing against a support, the ground in particular, a covering consisting of planks, laths, wooden panels, which consists in leveling the surface to be overlaid, then in fixing against the said surface, side-by-side planks, leaving a space between them and the ground, the spacing and the fixing of the said planks constituting the covering being obtained by means of pairs of elements distributed the one over the length of the said planks, the other over the support to be overlaid.

The process according to the invention is characterized in that the said fixing elements take the form of mutually spaced elementary blocks which extend transversely the one over the lower face of the plank and the second over the ground, the opposite faces of the said blocks comprising interlockable complementary zones ensuring the mutual securing of the said elements.

According to a preferred embodiment in accordance with the invention, the said fixing blocks are of parallelepipedal general shape and comprise a rectangular base surmounted by a plurality of teeth spaced apart, the lateral faces of which advantageously exhibit a slight conicity, of the order of from 3 to 5°. Consequently, fixing is obtained by simply engaging the teeth of the block fixed underneath the plank between the teeth of the block fixed to the ground.

The very small conicity of each tooth makes it possible to obtain a self-tightening assembly and direct fixing by friction, installation being obtained in a very simple manner with the aid of a hammer blow on the plank.

Preferably, the teeth are distributed in series over the length of each elementary block, openings being provided in the thickness of the base, in the zones situated between two series of teeth so as to make it possible to screw the linking blocks on the one hand, to the underside of the plank and on the other hand, to the ground or other structural elements (walls, ceilings).

To prevent the system from coming loose, especially following large temperature swings to which the terrace is subjected or on account of water ingress, it is conceivable, during installation, to deposit a spot of adhesive on the teeth of one or both fixing blocks. The amount of adhesive interfaced on the tooth being proportional to the tensile strength of the joining assembly, it will therefore be calculated for, for example, removing the plank with a predetermined force of for example the order of 100 kg. It will be possible to adapt the force of resistance by making a profile comprising a greater or lesser number of teeth offering a greater or lesser surface for adhesion or bonding.

Another solution for ensuring the mutual securing of the fixing blocks and strengthening the resistance to crushing, consists in providing means for anchoring at the end of one or more teeth which are able to be snap-fitted against the lower face of the block opposite the end of the said teeth when the two elementary blocks are associated.

The fixing blocks in accordance with the invention will be made from any appropriate material, but will preferably be based on a thermosetting polymer which is resistant to water and to thermal swings with little dimensional variation as well as to aggressive cleaning agents and which can be bonded with no particular constraint.

By way of indication, polyamide, polyethylene or polypropylene may be used as substance. Of course, the choice of such materials is not limiting.

Regarding the adhesive which may optionally be used to improve the bond between the two elementary blocks, use may be made of an adhesive of epoxy type, or conventional polyurethane or any other equivalent adhesive.

According to another preferred embodiment in accordance with the invention, to prevent the water which infiltrates under the planks from also flowing between the fixing blocks and the underside of the plank and/or the ground, a wedge or a washer based on an elastomer in particular forming a seal and which, being compressed, plays the role of waterproofing barrier, can be interposed between each elementary block and the surface against which it bears.

Lastly, according to a preferred embodiment, the visible surface will comprise relief patterns thereby, on the one hand, promoting the flow of water and, on the other hand, rendering the structure nonslip. These relief patterns, made integral, eliminate the risks of water infiltration and hence of degradation of the wood.

These patterns should have no negative angle which could create, in the event of wood shrinkage phenomena, drying cracks, and hence the risks of water entry. The positive relief pattern is therefore machined with a rounding on its lower part, at the bottom of the bond with the plank, and as a convex shape on its upper part, so as to aid the flow of water. Preferably, the pattern will be round, thereby avoiding sharp angles which generate stress concentrations, and hence the risks of cracks.

BRIEF DESCRIPTION OF THE DRAWINGS

The invention and the advantages it affords will however be better understood by virtue of the exemplary embodiment given hereafter by way of nonlimiting indication and which is illustrated by the appended drawings in which.

DESCRIPTION OF THE INVENTION

In the concrete exemplary embodiment which will be given hereinbelow, the invention will be described in respect of a wooden floor or terrace, made from laths, designated by the general reference (1) having a base width of 67 mm and a thickness of 25 mm, the length of each lath being one metre, the cross section of the said planks as well as the dimensions of the fixing elements embodied in accordance with the invention being represented substantially actual size in FIGS. 2 to 6.

As stated previously, it is obvious that such dimensions are not vital and that the invention could be implemented with planks or linking blocks having different dimensions.

Figure 1:
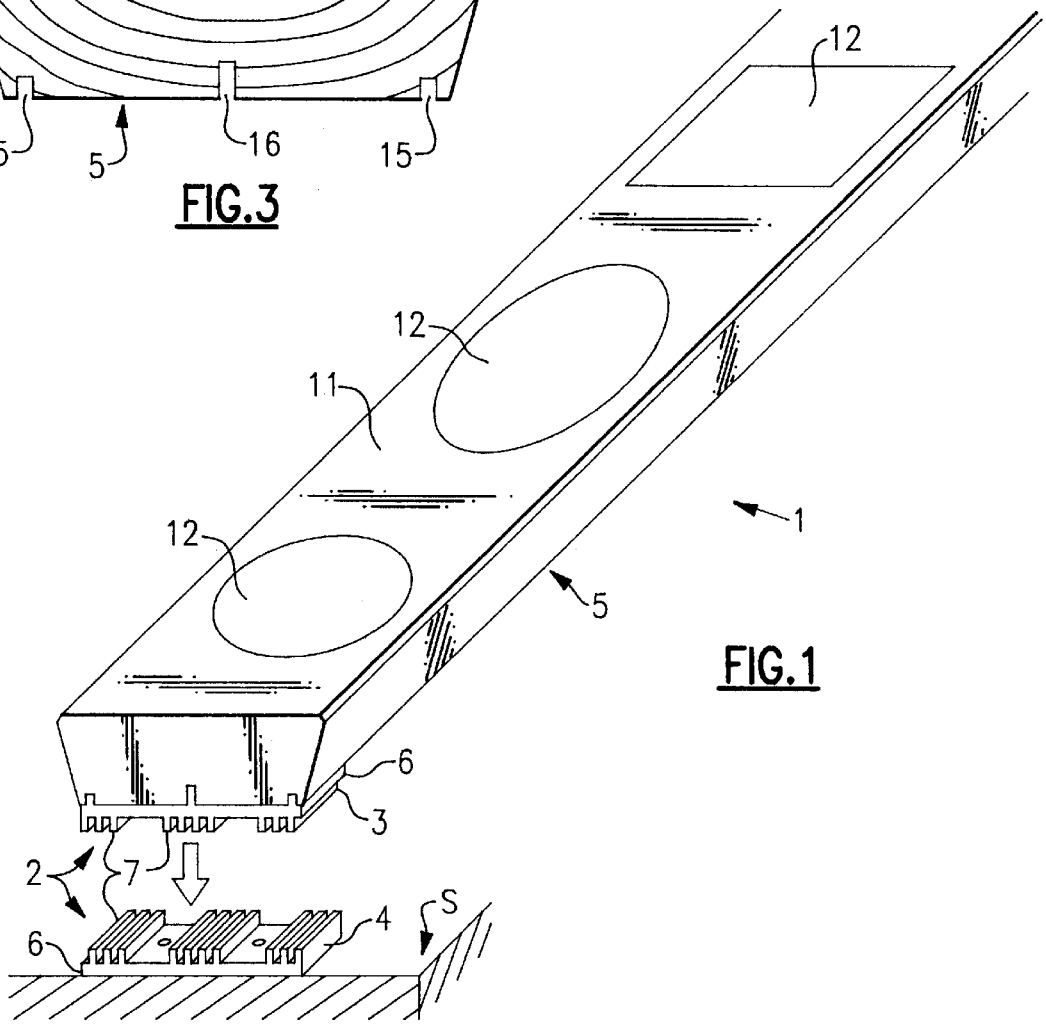
FIG. 1 is an overall view, in perspective, illustrating the manner in which the process in accordance with invention is implemented for installing planks intended to produce the covering, a single fixing assembly being represented.
Figure 4:
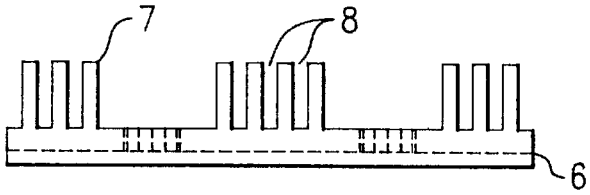
FIGS. 4, 5 and 6 are respectively views in elevation, from below and from the side of a fixing block for implementing the process according to the invention.
Figure 5:
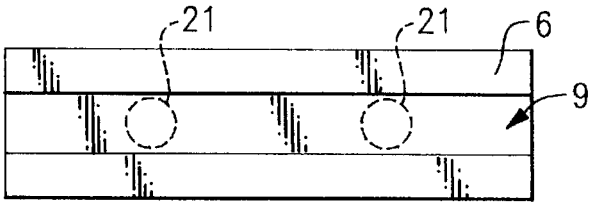
Figure 6:
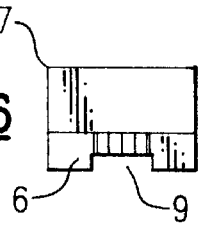
Figure 7:
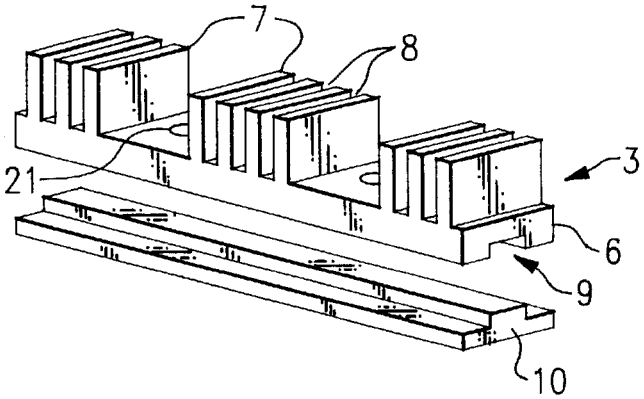
FIG. 7 is an exploded perspective view representing another embodiment of a fixing block in accordance with the invention, associated with a wedge making it possible to prevent any infiltration of water underneath the base of the said block.

Referring to FIG. 1, the elementary planks (1) of the covering to be made are therefore fixed to substrate which may be the ground (S) which has previously been leveled by means of an assembly of fixings, designated by the general reference (2), which consist of pairs of elements (3, 4) taking the form of blocks or blocks of parallelepipedal general shape, the one (3) being fixed to the lower face (5) of the plank (1), the second (4) being, for its part, fixed to the ground. To ensure the fixing of the plank to the ground, and to do so in a manner spaced from the latter, there is distributed over the length of the plank, regularly spaced with respect to one another, for example at least at the two ends, linking assemblies (2), but which may possibly comprise one or more intermediate elements in the case of very long planks.

The elementary linking blocks (3, 4) may either be of strictly identical structure or exhibit particular adaptations depending on whether they are intended to be fixed to the ground or against the inside face of the planks.

In both cases, each assembly (3, 4) comprises a base, designated by the same reference (6), of rectangular shape, but which could be round, this base being surmounted by complementary joining elements which, in the present case, take the form of teeth, designated by the same reference (7), and which may be distributed in groups along the blocks. These teeth are separated by empty spaces (8). In the example given, these teeth are distributed in three groups as illustrated in the appended FIGS. 4 to 7, these teeth having a height of 9 mm and a thickness at their free end of 2 mm. The spacing between each tooth is also 2 mm. The lateral faces of the said teeth exhibit a slight conicity, of the order of 3°, such that when the two blocks (3, 4) are engaged, self-tightening and direct fixing by friction are obtained. The fixing of the block (3) against the reverse face of the plank (1) and of the block (4) against the ground, is obtained by any appropriate means, in particular by means of screws which pass through orifices (21) provided between the groups of teeth in the central part of the base. Such linking blocks are preferably made by moulding a plastic, polyethylene or polypropylene for example.

After installing the joining element (4) on the ground and the joining elements (3) under the plank (1), the final link is made by simple engagement with the aid of a hammer blow on the plank.

To strengthen the join between the elementary blocks, it is conceivable to deposit spots of adhesive on one of the series of teeth.

Figure 8:
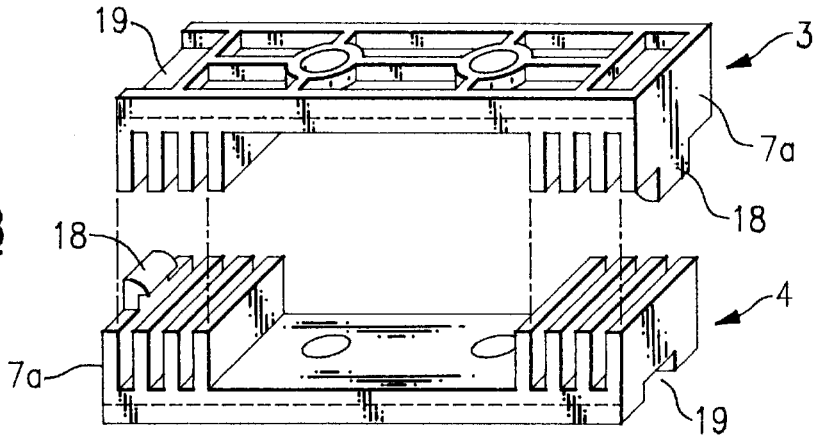
FIG. 8 is an exploded perspective view showing a pair of fixing blocks in accordance with the invention, comprising means of snap fitting between the two blocks.

Another solution making it possible to obtain such strengthening in the join consists in adopting the structure of the blocks which comprise means making it possible not only to have respective mutual engagement of the teeth, but also snap-fitting of at least one of the teeth into the base of the opposite block. Such a possibility is obtained by implementing the variant illustrated by FIG. 8.

In such a case, at least one of the teeth, for example the extreme tooth **(7*a*) comprises at its upper part a protuberance (18) in the form of a catch. When mutually interlocking the two blocks, the catch (18) will snap fit into a recess (19)** provided on the external face of the block.

It would be conceivable also to have catches in the middle part, openings then being provided in the base of each block to allow the passage of the said catches.

Figure 2:
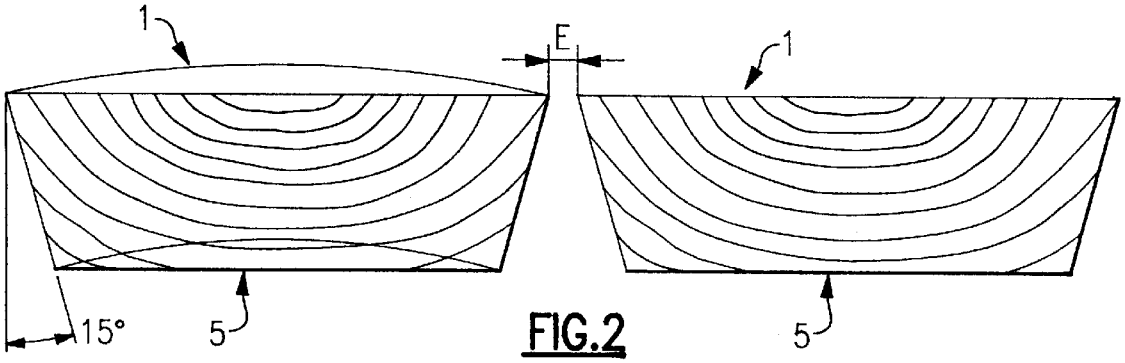
FIG. 2 illustrates the manner in which two consecutive planks are preferably disposed side-by-side.
Figure 3:
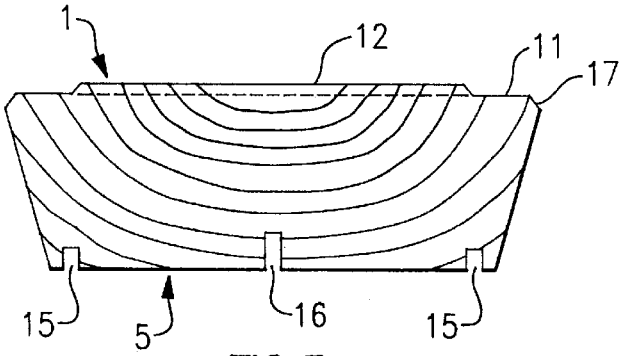
FIG. 3 is a sectional view showing the preferred cross section which a plank should have for the implementation of the process according to the invention.

The installing of the laths one beside the other can be done either by abutment, however preferably, the laths will be spaced by a space (E), as represented in FIG. 2, of the order of from 5 to 10 mm, thus making it possible, when the flooring is made, to improve ventilation and also to aid sweeping and cleaning.

Moreover, to aid the disposal of ground waste, the edge of the planks (1) will preferably be profiled with a variable angle, but which is in general of the order of from 10 to 15°. This profile is preferably extended over the length cut in cross section and the angle of the plank is preferably broken by a chamfer or a rounding (see FIG. 3) so as to make it possible to improve its mechanical durability. Although, as stated previously, the joining blocks may be identical, it will however be advantageous to adapt the block (3) so that it has a structure as illustrated in FIGS. 4 to 7 by providing, in its base (6), a groove (9) allowing the installation of a seal (10) made of an elastomer for example, which plays a waterproofing barrier role and prevents water from infiltrating between the fixing and the plank.

Additionally, and again so as to better aid the flow of water as well as to limit the slippage effect, the deck of the upper surface (11) of each plank will preferably comprise a relief pattern (12) made integral. Such a pattern (12) has a form which may be variable such as is represented in FIG. 1, and preferably will not exhibit any negative angle which could be the cause of shrinkage of the wood and hence of cracks allowing the infiltration of water. The positive relief pattern (12) is machined with a rounding on its lower part, at the bottom of the link with the plank, and has a convex shape on its upper face, aiding the flow of water. This can equally well be applied to a pattern with a rectangular or round base, a round pattern being preferable however, since it allows the reduction of sharp angles which generate stress concentrations, and hence the risks of cracks.

This pattern will of course have a diameter less than the width of the plank and it is possible to have patterns with several diameters on one and the same plank, so doing from an aesthetic point of view. For durability reasons, it may however exhibit a surface preventing its shearing, which surface should not in general be less than 1000 $mm^2$ in area, i.e. a minimum diameter of 35 mm.

It should also be noted that each plank (1) preferably incorporates a drip (15) into its profile, together with, over the whole of its length, a shrinkage notch (16), the angle of the plank also being broken by a chamfer or rounding (17).

The width of the plank can vary, attempting however to play a role as regards the stability and durability of the covering formed. Specifically, wood dries in the sun and absorbs water when it rains. Associated with these hygroscopic movements are dimensional variations which generate internal tensions in the plank. Given that the shrinkage coefficient of wood is twice as large in the tangential direction (axis of the cylindrical growth ring) as compared with radial shrinkage (perpendicular to the growth ring), the cross section of the plank will tend to deform when drying, possibly as far as to crack. Consequently, to decrease these internal tensions, plank widths not exceeding 10 to 14 cm should be used. In all cases, the cross section of the plank can be stabilized with an unloading notch on the underside (16) (see FIG. 3). In the case of bigger widths, elements obtained by the "rift sawing" (or quarter sawing) technique should be used, thus making it possible to decrease the internal tensions as compared with a flitch plank, but which have the drawback however of being more expensive. Moreover, during fitting, it is advantageous for the plank to be designed in such a way as to deform into a convex shape, as represented dotted on the lath situated on the left in FIG. 2, thus allowing faster and more complete disposal of surface water.

The invention can be implemented for any type of wood but, when making floorings or terraces outdoors, conventional species such as Ipé or Iroko will be used. Other species could optionally be implemented, for example beech after having been made to undergo an appropriate treatment, in particular a dressing treatment. Although it is conceivable to use any type of wood species, preferably, the species will be selected as a function of its shear properties, thus making it possible to improve the durability of the relief patterns (12) and, additionally, to use species which are not very "sinewy" and so allow better dimensional stability, thereby decreasing the internal tensions and hence the risks of cracking.

What is claimed is:

1. An outdoor flooring system that is laid down upon a level substrate, that includes planks that are laid down end to end in spaced apart rows upon said substrate, each plank containing at least two connectors spaced apart along the plank's underside, each connector further includes first and second base blocks having opposed surfaces, said blocks extending transversely across the underside of said plank at one end thereof, the blocks further including spaced apart teeth mounted upon the opposed surfaces, said teeth extending longitudinally beneath the plank, the teeth of one block being interlocked with the teeth of the other block, and means for securing said first block to the plank and said second block to the substrate.

2. The system of claim 1 wherein each interlocking tooth has a rectangular profile, the longitudinal faces of said tooth converging downwardly from the top of the tooth toward said base block at an angle of between 3° and 5°.

3. The system of claim 2 that further includes adhesive means on the meshing longitudinal faces of said teeth for fixing the first and second base blocks together.

4. The system of claim 1 wherein one base block contains a recess at one end thereof and the other base block contains a catch that is snap fitted into said recess when the teeth are meshed in interlocking engagement thereby locking the blocks together.

5. The system of claim 1 wherein said first base block is secured to the underside of said plank by threaded fasteners that pass through receiving holes in said first base block and said second base block is secured to said substrate by threaded fasteners that pass through receiving holes in said second base block.

6. The system of claim 1 that further includes a seal interposed between the first base block and the planks and the second base blocks and the substrate.

7. The system of claim 1 wherein each plank further includes raised relief patterns that are integral with the plank.

8. The system of claim 7 wherein said raised relief patterns are circular in form and have convex side walls whereby moisture will not collect around the raised relief patterns.

9. The system of claim 1 wherein the planks are fabricated of wood.

* * * * *